US006725591B2

(12) United States Patent
McLaughlin, Jr.

(10) Patent No.: US 6,725,591 B2
(45) Date of Patent: Apr. 27, 2004

(54) MESSAGE DELIVERY DEVICE AND DISPLAY SYSTEM FOR USE THEREWITH

(76) Inventor: John R. McLaughlin, Jr., 409 Old Garrison Rd., Dover, NH (US) 03820

( * ) Notice: Subject to any disclaimer, the term of this patent is extended or adjusted under 35 U.S.C. 154(b) by 0 days.

(21) Appl. No.: 09/812,674

(22) Filed: Mar. 20, 2001

(65) Prior Publication Data

US 2002/0020651 A1 Feb. 21, 2002

Related U.S. Application Data

(60) Provisional application No. 60/191,042, filed on Mar. 21, 2000.

(51) Int. Cl.[7] ..... G09F 3/18

(52) U.S. Cl. ..... 40/660; 40/306; 40/310

(58) Field of Search ..... 40/660, 306, 310, 40/311, 334, 335, 514, 650, 661.05, 312, 313; 63/1.14; 211/71.01, 85.18; 206/443, 446, 232; 229/5.5, 93; 283/56

(56) References Cited

U.S. PATENT DOCUMENTS

| | | | | | |
|---|---|---|---|---|---|
| 486,866 | A | * | 11/1892 | Frelinghuysen | 108/59 |
| 1,182,254 | A | * | 5/1916 | Cummins | 63/1.14 |
| 1,747,805 | A | * | 2/1930 | Van Der Linde | 229/4.5 |
| 2,232,333 | A | * | 2/1941 | McGehee | 70/456 R |
| 3,077,981 | A | * | 2/1963 | Gaspard | 206/223 |
| 3,471,957 | A | * | 10/1969 | Robb | 40/514 |
| 4,043,449 | A | | 8/1977 | Love | 206/45.14 |
| 4,333,562 | A | * | 6/1982 | Todd | 206/37 |
| 4,577,753 | A | * | 3/1986 | Marhal | 206/232 |
| 4,632,428 | A | * | 12/1986 | Brown | 283/76 |
| 4,842,140 | A | * | 6/1989 | Mesnard | 206/457 |
| 4,993,753 | A | | 2/1991 | Weeks | 283/102 |
| 5,000,344 | A | * | 3/1991 | Janssen | 221/92 |
| 5,016,373 | A | | 5/1991 | Theno | 40/594 |
| 5,046,609 | A | * | 9/1991 | Mangini et al. | 206/232 |
| 5,096,751 | A | | 3/1992 | Duchek | 428/12 |
| 5,141,117 | A | * | 8/1992 | Olsen et al. | 211/71.01 |
| 5,402,881 | A | * | 4/1995 | Manico | 206/225 |
| 5,592,766 | A | * | 1/1997 | Mygatt | 40/307 |
| 5,641,062 | A | | 6/1997 | Burton et al. | 206/232 |
| 5,657,875 | A | * | 8/1997 | Hirsh, III et al. | 206/767 |
| 5,682,999 | A | | 11/1997 | Larson | 206/768 |
| 6,301,812 | B1 | * | 10/2001 | Klunk | 40/124.06 |

* cited by examiner

*Primary Examiner*—William L. Miller
(74) *Attorney, Agent, or Firm*—Bourque & Associates, PA

(57) ABSTRACT

A message delivery device for communication between a sender and a receiver having a container, a cover having a label on it that is easily personalized to a specific sender, and a rolled-up message strip disposed within the container having a time-dependant message. The time-dependant message is read and displayed as the user un-rolls the message. A display system having rows to hold the message delivery devices and a pull-tab for displaying the time-dependant message outside of the container is also disclosed.

18 Claims, 12 Drawing Sheets

MESSAGE DELIVERY DEVICE AND DISPLAY SYSTEM FOR USE THEREWITH

CROSS-REFERENCE TO RELATED APPLICATIONS

This application is related to and claims the benefit of Provisional U.S. Patent Application No. 60/191,042 filed on Mar. 21, 2000 entitled MESSAGE DELIVERY DEVICE AND DISPLAY SYSTEM FOR USE THEREWITH and incorporated herein by reference.

TECHNICAL FIELD

The present invention relates to greetings or message devices, and more particularly, to a rolled up message or greeting within a container and a display system for use therewith.

BACKGROUND INFORMATION

Many different styles and designs for greeting cards have been developed over the years and are used for announcing parties, conveying greetings, and for otherwise communicating feelings or emotions. Numerous features have been used to enhance conventional greeting cards, such as pop-up three-dimensional figures. Despite these features, the general concept of the greeting card has not changed—the card is opened and the message is revealed.

Accordingly, there is a need for a unique device for delivering a message or other greeting in which the message is revealed differently than the traditional greeting card. There is also a need for a display system for such devices that allows the purchaser to view the hidden greeting or messages within the devices before purchasing.

SUMMARY OF THE INVENTION

The present invention features a message delivery device including a generally cylindrical message holding container having a removable cover and a rolled-up message strip within the message holding container. The message holding containers can have various colors and configurations and the covers of the message holding containers include some visible indicia such as pictures, words or the like, and can also include a To/From label in various colors and designs. The covers can be twist off or pull off type covers.

The present invention also features a display system comprising a container holder having one or more shelves at a front portion for holding the message holding containers. The display system can be located on a counter top, mounted as a rack display or can be free standing. One or more display messages strips are slidably disposed within a rear portion of the container holder and corresponding to the shelves of the container holder. Each of the display message strips includes a tab, preferably corresponding to the design of the cover of the containers being displayed on the corresponding shelves. The tabs are pulled to reveal the message within the containers on the corresponding shelf.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
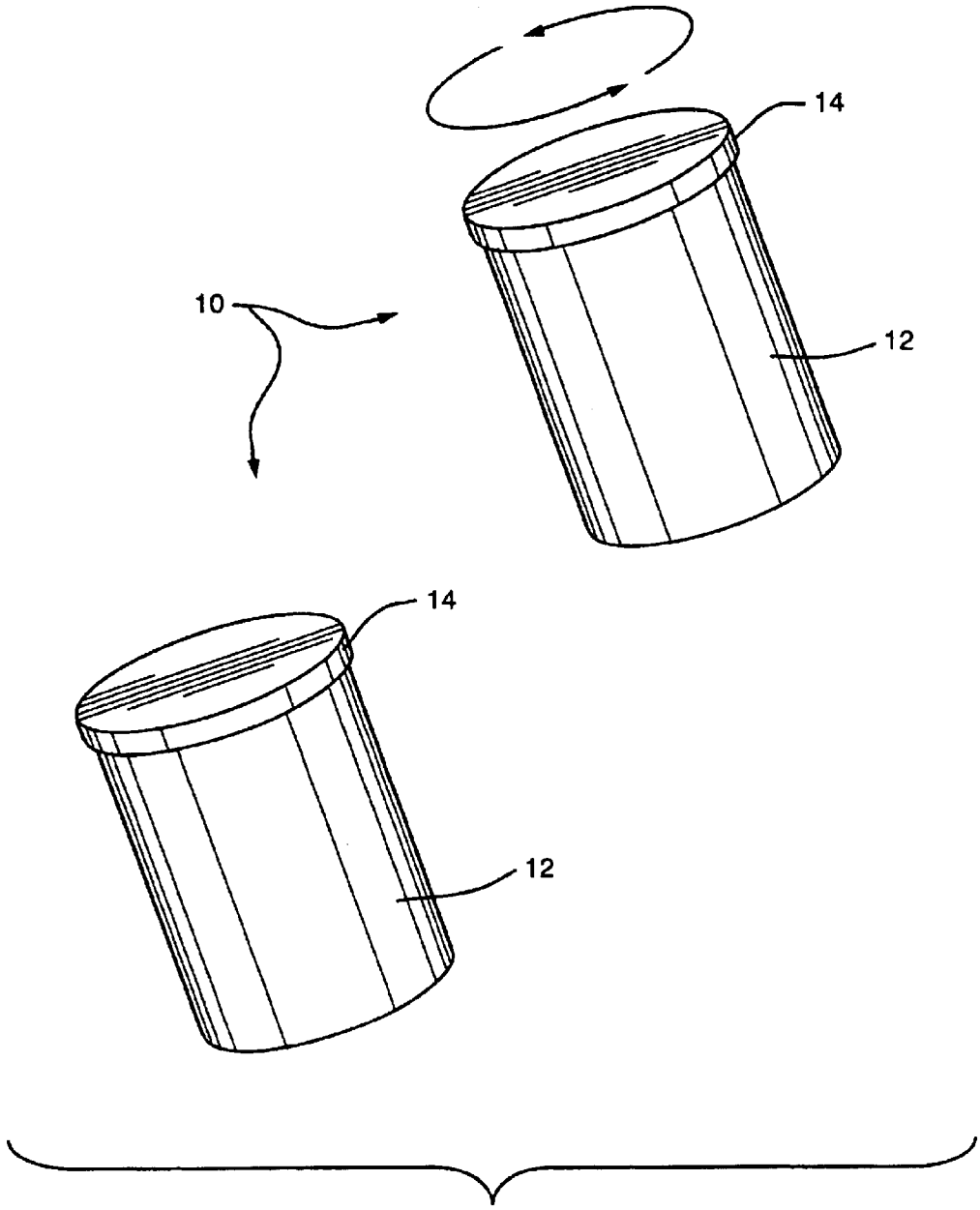
FIG. 1 is a perspective view of the message holding containers, according to one embodiment of the present invention.
Figure 2:
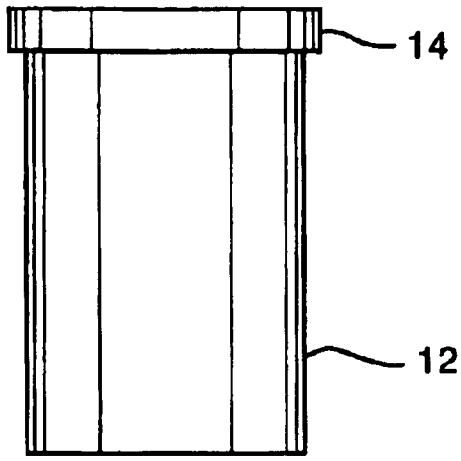
FIG. 2 is a side view of the message holding container, according to one embodiment of the present invention.
Figure 3:
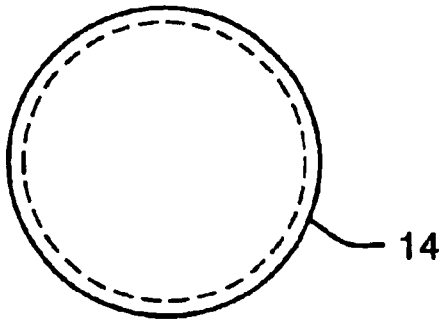
FIG. 3 is a top view of the message holding container, according to various embodiments of the present invention.

A message delivery device 10, FIGS. 1–3, according to the present invention, can be used to deliver greetings, invitations, or any other type of message. The message delivery device 10 includes a message holding container 12 and a cover or cap 14 removably engaged with the message holding container 12. The cap 14 can be either a twist off or pull off type cap.

In one example, the message delivery device 10 is generally cylindrical in shape and approximately the size of a film canister that is, about 2" high, 1-¼" wide. The message holding container 12 can be made in various other sizes and shapes.

The message holding container 12 and cap 14 can be made in various different colors and color combinations and with various design elements. The message holding container is preferably made from cardboard but can be made from various other papers or other materials including plastic and metal.

Figure 4:
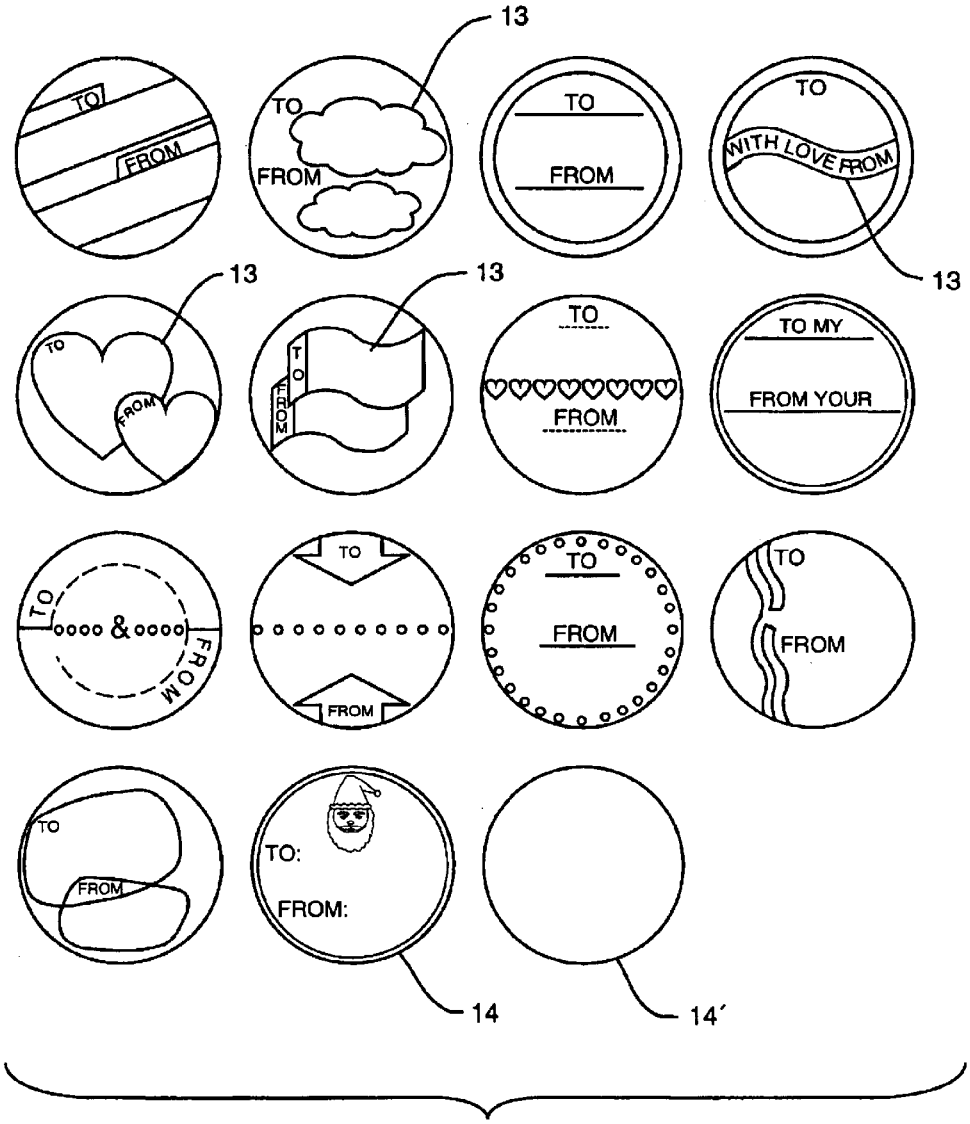
FIG. 4 shows a number of possible tops of message holding containers, according to some of the various embodiments of the present invention.

The caps or covers 14, FIG. 4, of the message holding container 12 preferably include a design or other indicia 13, preferably in color and preferably coordinated with the message or occasion to which the message relates. The cover 14 preferably also includes a To/From label with various colors and/or designs. The particular colors and designs may relate to a theme of the message, such as Valentine's Day, Christmas, or another holiday or special occasion.

Alternatively, the cap 14' may not have any design, allowing the purchaser to add a customized design or label. According to another alternative, the To/From label and/or design may appear on another portion of the message holding container 12, such as the side or bottom.

Figure 5A:
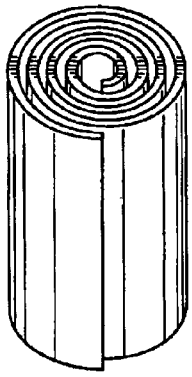
FIGS. 5A–5C illustrate a rolled up, partially rolled-up and unrolled message strip, according to one embodiment of the present invention.
Figure 6A:
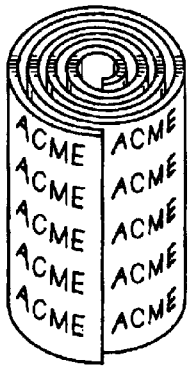
FIGS. 6A–6C illustrate a rolled up, partially rolled-up and unrolled message strip, according to another embodiment of the present invention.

A rolled-up message strip 20, FIGS. 5A and 6A, is disposed within each of the message holding containers 12. The rolled-up message strip 20 can be made of paper, plastic or any other suitable material capable of being printed on and rolled up. The rolled up message strip 20 includes the message text 22 and/or graphic designs 24 on either the inside surface 26 or the outside surface 28. In the preferred embodiment, the message to be displayed is printed on the outside surface and the inside surface may be blank.

Figure 5B:
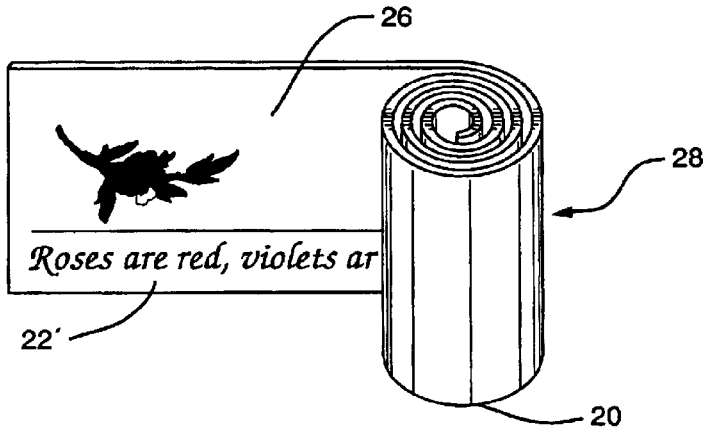
Figure 5C:
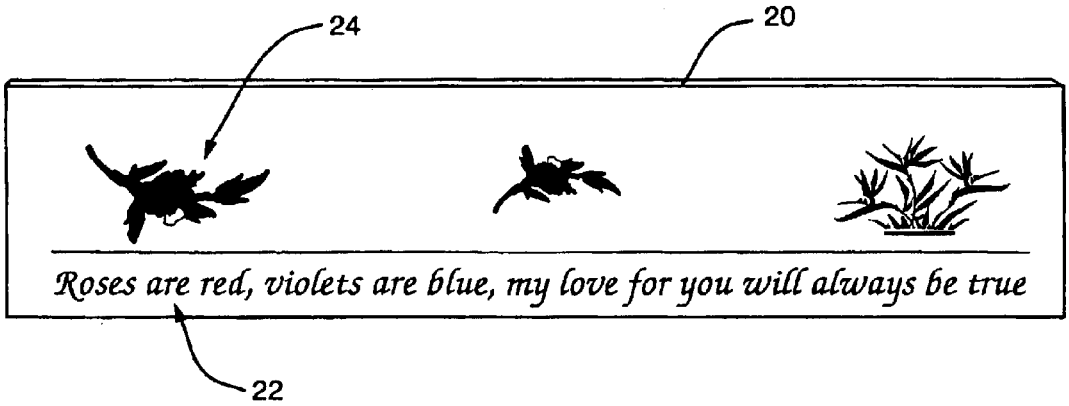
Figure 6B:
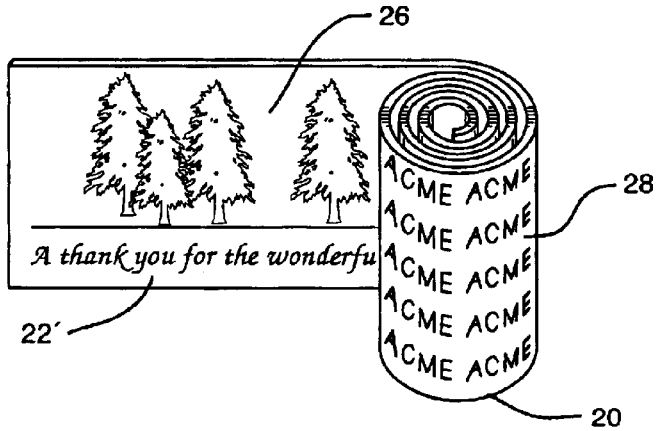
Figure 6C:
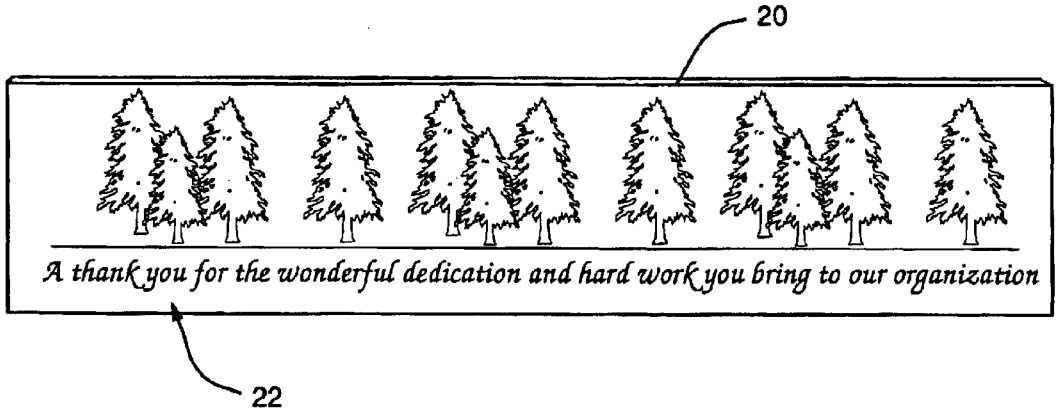

It is important to note that the message text 22 is displayed to the viewer in a time-dependant fashion wherein the reader is only shown the part of the message text 22', FIGS. 5B and 6B that is un-rolled. It is not until the strip 20 is fully unrolled, FIGS. 5C and 6C that the viewer can see the entire message. The act of unrolling the message strip 20 and the time dimension to the unrolling add to the gift-like enjoyment of the present invention.

In one embodiment (FIG. 5), the outside surface 28 includes a solid color or design, for example, a design motif corresponding to the message theme. According to another embodiment (FIG. 6), the outside surface 28 can include a corporate/company logo with a sales, motivational, or personal message on the inside surface 26. Alternatively, the rolled up message strip 20 can be printed only on one side.

Figure 7:
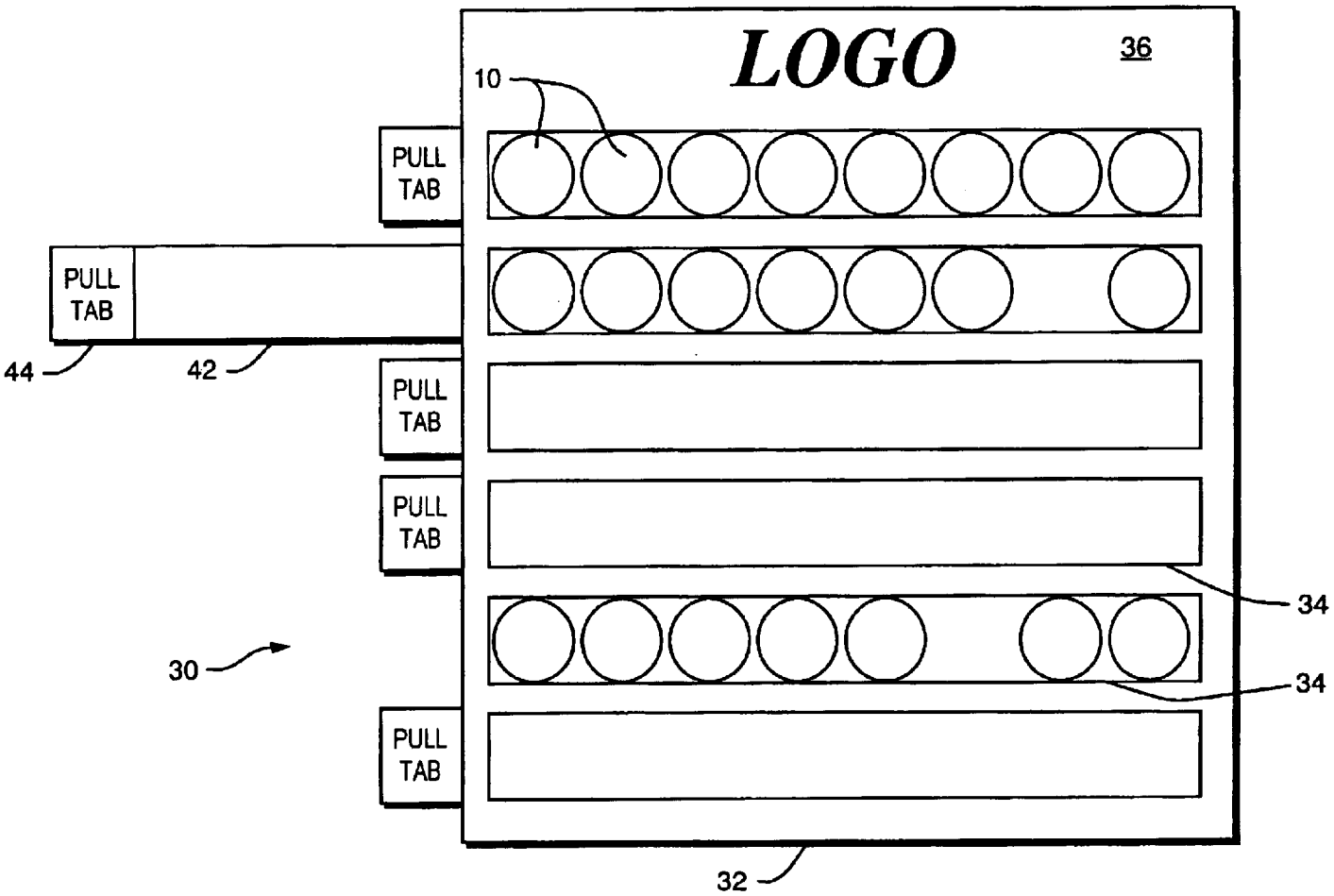
FIG. 7 is a front view of a display system, according to the present invention.
Figure 8:
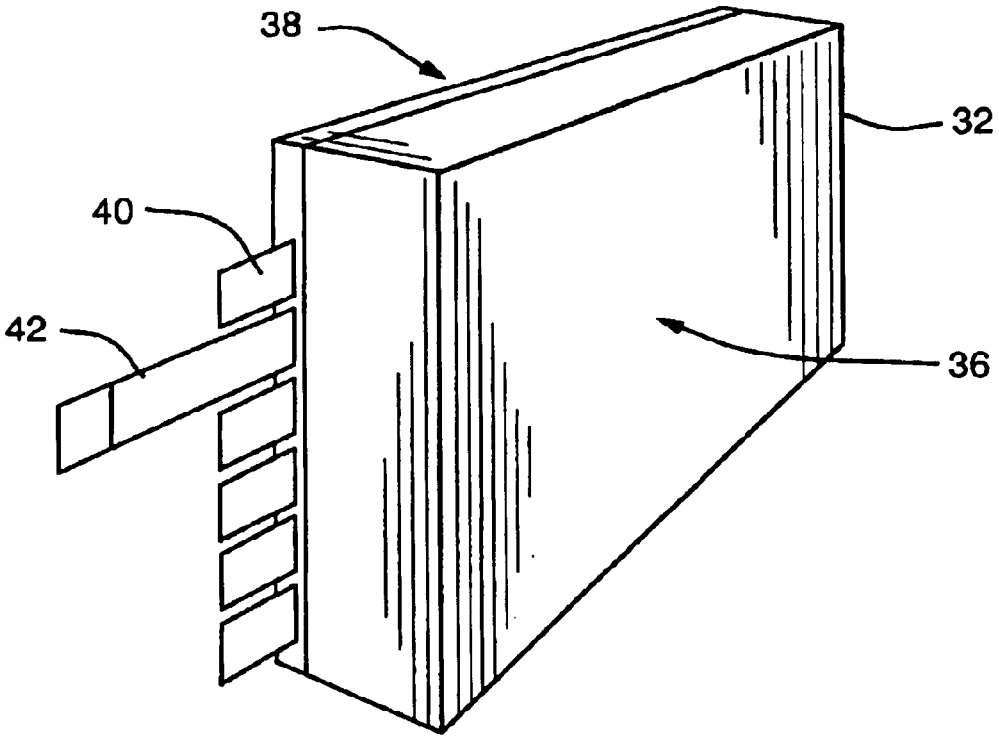
FIG. 8 is a front view of the display system, according to the present invention.

The present invention also features a display system 30, FIGS. 7 and 8, is used to display the message delivery devices 10, for example, to potential purchasers. The display system 30 includes a container holder 32 having one or more shelves 34 for holding a row of message delivery devices 10. The container holder 32 includes a front portion 36 for displaying the caps 14 of the message delivery devices 10. A rear portion 38 of the holder 32 includes slots 40 or other similar means of holding a message bearing strip 42 on which is mounted an unfolded message for and corresponding to each row of message delivery devices 10.

A display message strip 42 is slidably disposed in each slot 40 corresponding to each row of message delivery devices 10. The display message strip 42 displays the message text contained within each of the message delivery devices 10 on that corresponding row.

The message strip 42 preferably includes a pull-tab 44 for each message delivery devices 10 in the corresponding row. The pull-tab 44 can have a corresponding color (FIGS. 7 and 9) or a corresponding design (FIG. 10) as the message in the message delivery device 10.

Figure 9:
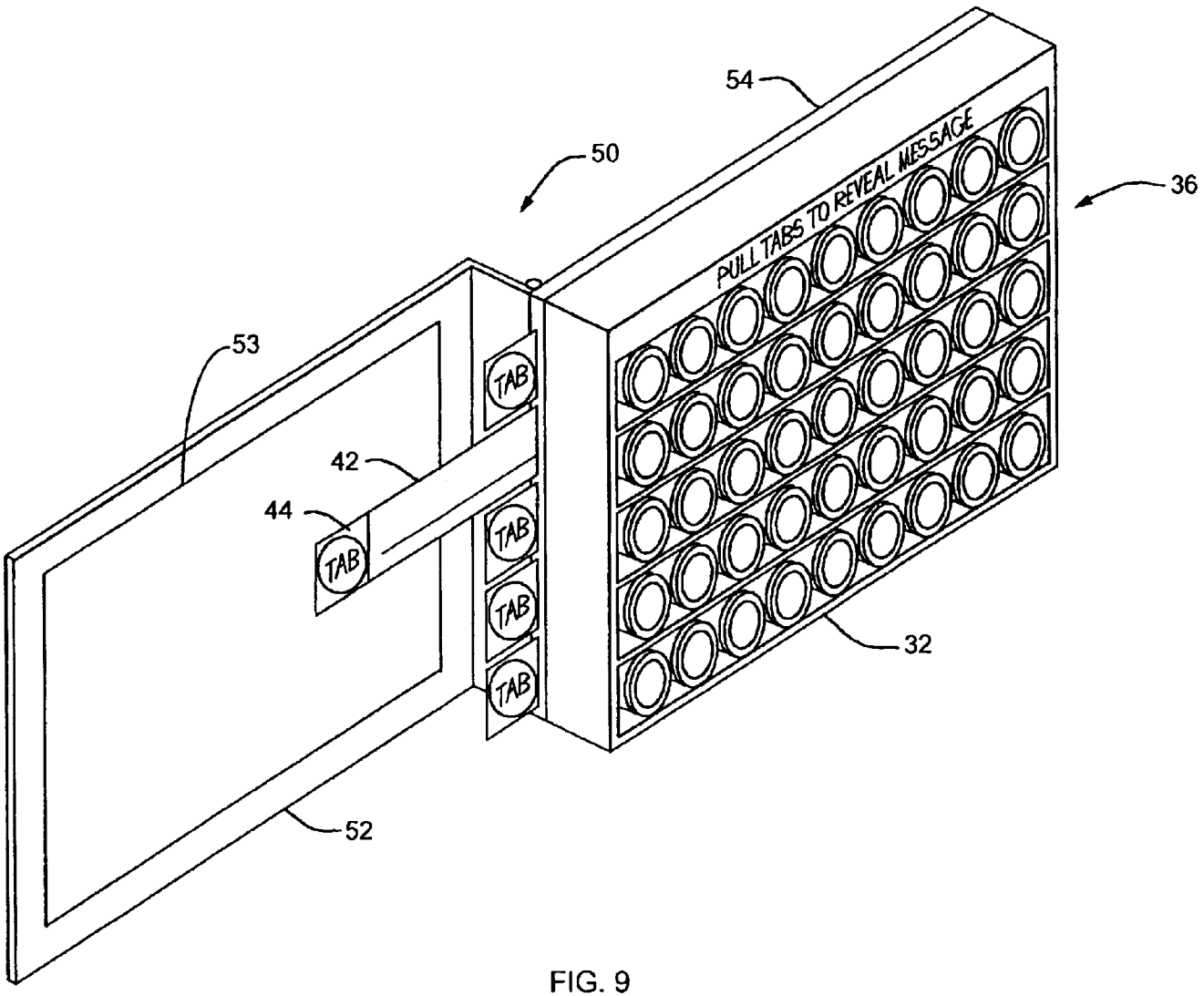
FIG. 9 is a perspective view of an open display system according to one embodiment of the present invention.
Figure 10:
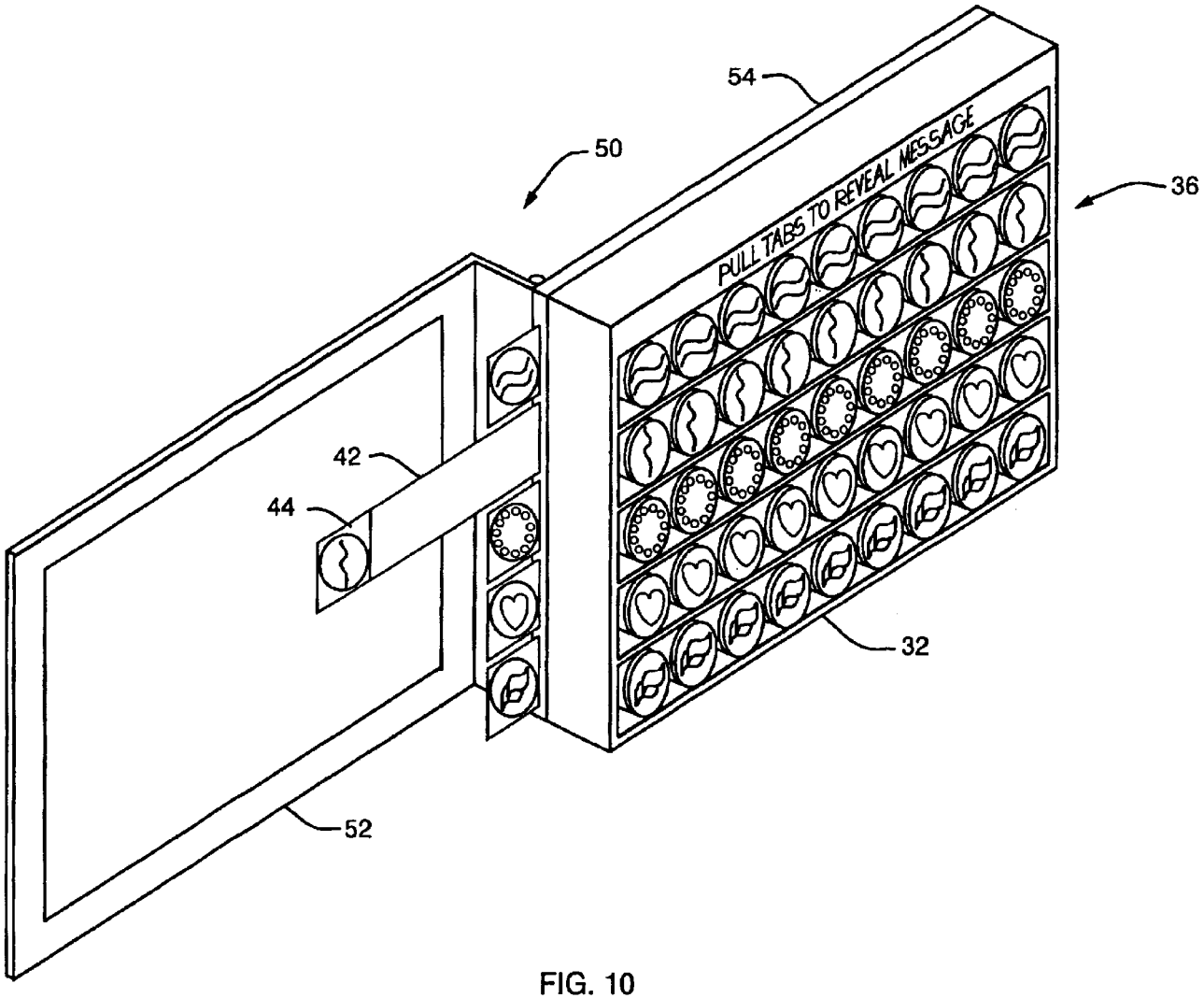
FIG. 10 is a perspective view of a display system according to another embodiment of the present invention.
Figure 11A:
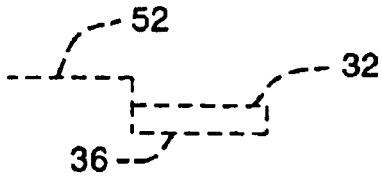
FIGS. 11A–11D illustrate the closing of the display system of the present invention.
Figure 11B:
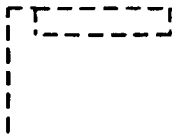
Figure 11C:
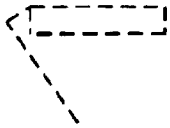
Figure 11D:
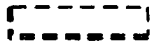

In one embodiment, the holder 32, FIGS. 9 and 10, is formed as part of a self-standing container 50. The self-standing container 50 includes a hinged back panel 52. The hinged back panel 52 folds over the front portion 36 of the holder 32 for easy packaging and handling (FIGS. 11A–11D). The back panel 52 helps support the self-standing container 50 in an upright position. The back panel 52 may include promotional sales materials, pictures, advertising or the like 53. In this embodiment, the message strips 42 are provided in a separate cartridge 54 that slides into or locks onto the back portion of the holder 32.

Figure 12:
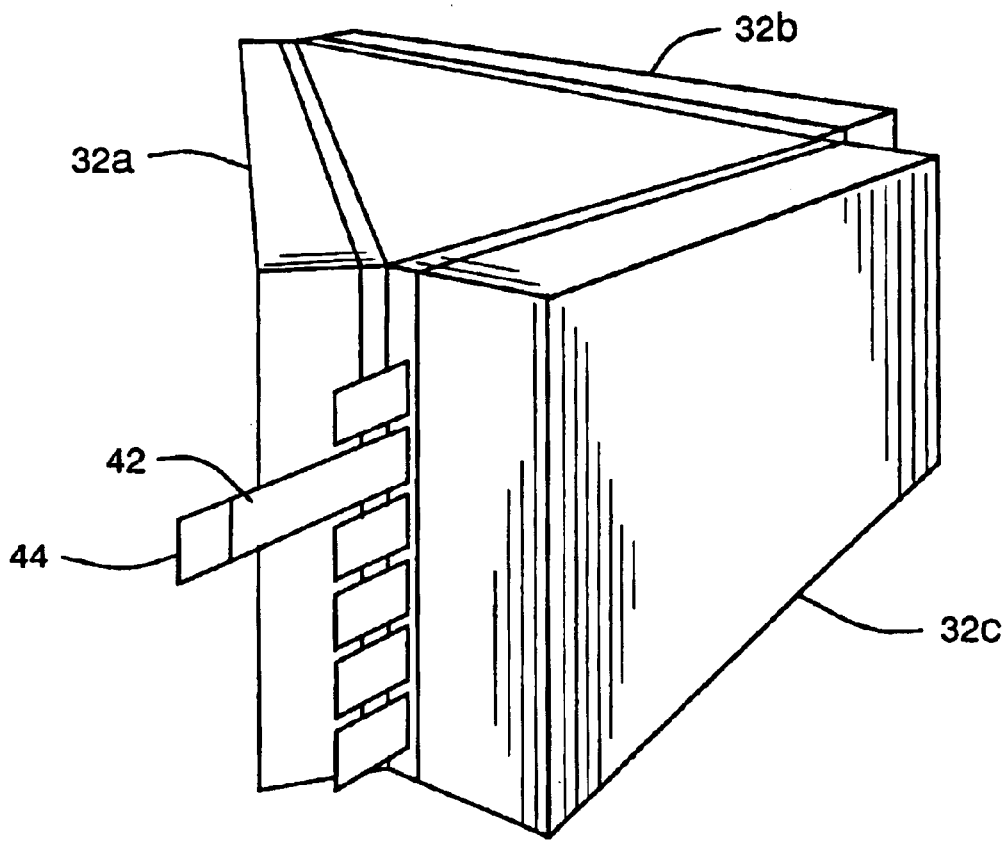
FIG. 12 is a perspective view of a multi-sided display system, according to one embodiment of the present invention.
Figure 13:
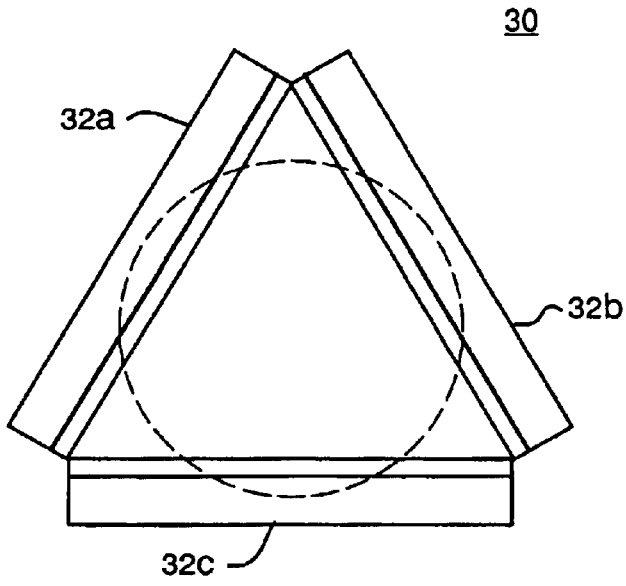
FIG. 13 is a top view of the multi-sided display system shown in FIG. 12.
Figure 14:
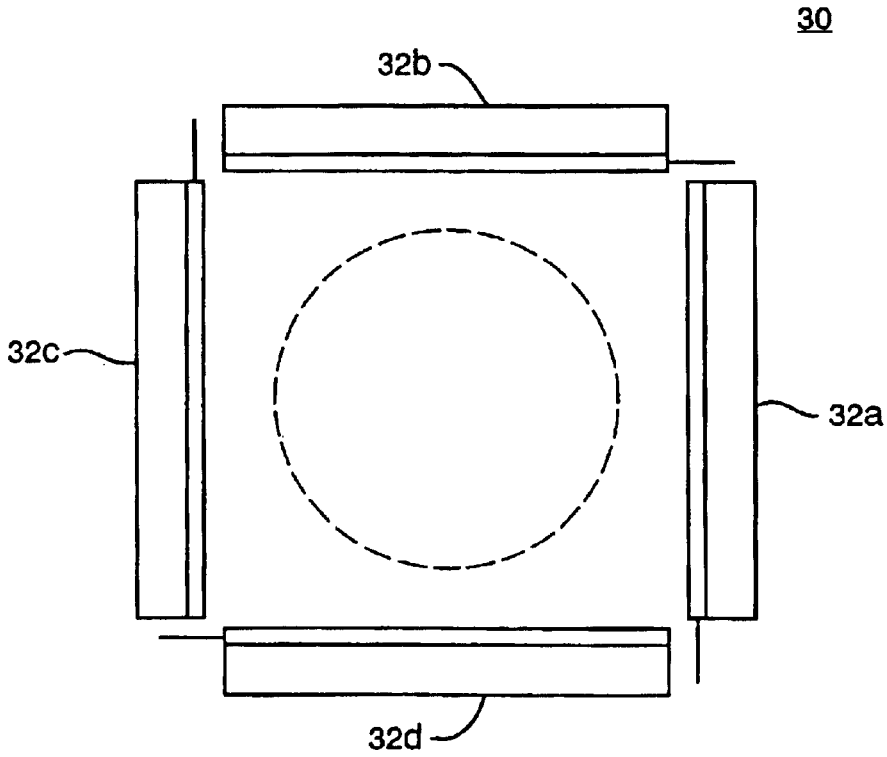
FIG. 14 is a top view of a multi-sided display system, according to further embodiment of the present invention.

In another embodiment, the display system 30, FIGS. 12–14, includes multiple holders 32*a–d* to form a multi-sided revolving stand. Each of the sides or holders 32*a–d* can include message delivery devices 10 corresponding to a theme, for example, birthday, anniversary, graduation, wedding and the like.

Accordingly, the message delivery device of the present invention provides a unique way of delivering a greeting or message in a container that is a gift as well as a card. The unique display system allows the public to view the message contained within the containers in a way that is similar to actually unwinding the message or greeting.

Modifications and substitutions by one of ordinary skill in the art are considered to be within the scope of the present invention, which is not to be limited except by the claims which follow.

What is claimed is:

1. A message delivery device for communication between a sender and a receiver comprising:

a message holding container, said message holding container being generally cylindrical in shape and having an opening proximate at least one end of said container and a message storage portion, said opening having a cross-sectional area that is generally the same as a cross-sectional area of said message storage portion;

a cover, including a base having an inner and an outer surface and a lip portion extending from said base, said lip portion sized to removeably frictionally engage an outer surface of said opening of said message holding container such that said opening of said message holding container is in close proximity with said inner surface of said base, said cover adapted to be easily personalized by said sender for a specific receiver, said cover further including a design element having a predetermined design theme; and a rolled-up message strip sized to fit substantially within said message storage portion of said message holding container, said rolled-up message strip having an inside and an outside surface adapted to display a message which is displayed to a receiver over time as said rolled-up strip is unrolled, said message strip further including at least one design element having a design theme which is coordinated with said predetermined design theme of said design element on said cover.

2. The message delivery device as claimed in claim 1 wherein said message holding container and said cover are a material selected from the group consisting of paper and plastic.

3. The message delivery device as claimed in claim 2 wherein said message holding container is generally opaque.

4. The message delivery device as claimed in claim 2 wherein said rolled-up message strip is made of a material selected from the group consisting of paper, cardboard, plastic, and metal.

5. The message delivery device as claimed in claim 4 wherein said message on said rolled-up message strip includes a graphical design.

6. The message delivery device as claimed in claim 4 wherein said rolled-up message strip further includes at least a second message printed on said outside surface.

7. The message delivery device as claimed in claim 6 wherein said rolled-up message strip relates to a theme message.

8. The message delivery device as claimed in claim 1 wherein said cover further includes at least one label having at least a first and second indicia section having various designs, said first and said second indicia sections representing from whom said message delivery device is sent from and to whom said message delivery device is intended for, respectively.

9. The message delivery device as claimed in claim 8 wherein said label relates to a theme message.

10. The message delivery device as claimed in claim 1 wherein said cover further includes at least one design and at least one color.

11. The message delivery device as claimed in claim 1 wherein said message holding container is approximately 2 inches in height and 1.25 inches wide.

12. A display system comprising:

at least one shelf adapted to hold at least one row of a plurality of message delivery devices;

a front portion adapted to display at least a cap of said plurality of message delivery devices;

a rear portion having at least one slot corresponding to each of said rows of said message delivery devices; and a display message strip slidably disposed in each of said slots, said display message strip adapted to display a rolled message contained in each of said plurality of message delivery devices.

13. The display system as claimed in claim 12 wherein said display message strip further comprises at least one pull-tab.

14. The display system as claimed in claim 12 wherein said display system is part of a self-standing container, said self-standing container comprising an adjustable back panel and at least one supporting portion.

15. The display system as claimed in claim 14 wherein said adjustable back panel further includes promotional sales material.

16. The display system as claimed in claim 14 wherein said self-standing container is rotatable.

17. The display system as claimed in claim 12 wherein said display system includes a plurality of sides for displaying a plurality of caps of said message delivery devices.

18. A combined display system and message delivery device for communication between a sender and a receiver comprising:

a message delivery device comprising:

a message holding container, generally cylindrical in shape, opaque, and made of a material selected form the group consisting of paper and plastic;

a cover removably engaged with said message holding container and adapted to be personalized by said sender for a specific receiver; and a rolled-up message strip disposed within said message holding container, and having an inside and outside surface and a time-dependant message; and a display system for holding said message delivery device, said display system comprising:

a plurality of shelves, each of said plurality of shelves adapted to hold a row of a plurality of said message delivery devices;

a front portion adapted to display at least one cover of each of said plurality of rows of message delivery devices;

a rear portion having at least one slot for each of said rows of said message delivery devices; and a display message strip slidably disposed in each of said rear portion slots, wherein each of said display message strips is adapted to display a rolled up message strip contained within said message delivery devices in said row.

* * * * *